United States Patent [19]

Clark

[11] 3,942,211

[45] Mar. 9, 1976

[54] BRUSH WITH REMOVABLE BRUSH STRIPS

[76] Inventor: Gaylord J. Clark, 4679 Paw Paw Lake Road, Coloma, Mich. 49058

[22] Filed: Sept. 10, 1974

[21] Appl. No.: 504,801

[52] U.S. Cl. ..... 15/183

[51] Int. Cl.[2] ..... A46B 7/04; A46B 7/10

[58] Field of Search ..... 15/179, 182, 183, 202, 15/230.14; 19/60; 29/124

[56] References Cited

UNITED STATES PATENTS

| | | | |
|---|---|---|---|
| 258,618 | 5/1882 | Winkle | 19/60 |
| 365,374 | 6/1887 | Drill | 15/183 X |
| 493,691 | 3/1893 | Elam et al. | 19/60 |
| 887,780 | 5/1908 | Eberhardt | 19/60 |
| 1,727,627 | 9/1929 | Appleton | 15/179 X |
| 3,393,418 | 7/1968 | Mundo | 15/183 |
| 3,546,731 | 12/1970 | Ahern | 15/183 |

*Primary Examiner*—Daniel Blum

*Attorney, Agent, or Firm*—Woodhams, Blanchard and Flynn

[57] ABSTRACT

A rotary brush construction, particularly for washing vehicles, having a pair of spaced collars mounted upon a shaft and supporting a plurality of elongated bristle holding members arranged in a cylindrical pattern concentric with the shaft. Each collar has an annular flange extending axially thereof, which flange has a plurality of circumferentially spaced slots extending axially inwardly from the free end thereof. The flanges of the collars are directed so that the slots formed in the plurality of collars all open axially in the same direction. Each bristle holding member has fastening elements, such as threaded fasteners, mounted on and positioned so as to be slidably received within a corresponding slot formed on a collar for permitting the bristle holding member to be fixedly secured to the collar. Since the slots all open in the same axial direction, the bristle holding members can be removed by loosening the threaded elements and then sliding the member lengthwise in a direction substantially parallel to the axis of the shaft. The bristle holding members can similarly be remounted on the collars in the reverse manner to that described above.

2 Claims, 5 Drawing Figures

BRUSH WITH REMOVABLE BRUSH STRIPS

FIELD OF THE INVENTION

This invention relates in general to rotary brushes and, more particularly, to a type thereof having a plurality of elongated bristle holding members which are removably secured to a pair of end collars so that the members define a cylinder from which the brush bristles extend radially outwardly.

BACKGROUND OF THE INVENTION

Persons acquainted with the manufacture and operation of rotary brushes, and particularly those used in car washing operations, realize that the rotary brushes undergo rapid wear. Further, the bristles often become caught on various protruding portions of the vehicle, thereby causing breakage of the bristles. The bristles associated with the brush also often wear in a nonuniform manner due to the irregular profile of the vehicle. Replacement of the bristles is thus a necessary maintenance operation. To improve the efficiency of this maintenance operation, some brush constructions have mounted the bristles on elongated bristle carrying members or strips, with a plurality of these strips being mounted on a core or drum to result in formation of a cylindrical brush. Brush constructions of this general type are disclosed in U.S. Pat. No. 3,393,418, issued to L.J. Mundo, and in U.S. Pat. No. 3,529,314, issued to Gaylord J. Clark.

Brush constructions utilizing removable bristle carrying members or strips, as disclosed in the above-mentioned patents, have greatly simplified maintenance and repair by permitting sections of the brush construction to be repaired in a manner which is more efficient than the techniques previously utilized. However, in these known structures, the bristle carrying members have been connected to spaced collars by means of threaded fasteners, such as bolts or screws. These threaded fasteners, and the manner in which they connect the bristle holding members to the respective collars, have necessarily required that the fastener either be threadably disconnected from the collar or totally removed from the bristle carrying member in order to permit removal of the members from the collars. The necessity of having to remove the threaded fasteners prior to removal of the bristle carrying member does itself introduce some disadvantages. For example, removal of the threaded member is consuming and, since many repair operations must be accomplished in a minimal time so as to minimize shut-down time of the operation, the use of removable threaded fasteners has proven unacceptable in some situations. The use of removable fasteners is also undesirable since the loose fasteners tend to become lost or misplaced after the brush construction has been disassembled. Still further, many of the known structures have utilized a threaded fastener consisting of a bolt having a nut threaded on the inner end thereof. This type of structure has proven undesirable in many situations since the nut, by being positioned interiorly of the brush construction, is often positioned so that access to same is extremely difficult.

Accordingly, a primary object of this invention is the provision of a relatively inexpensive, rotary brush construction which overcomes the above-mentioned disadvantages. Particularly, in the brush construction of the present invention, both the cost of initial manufacture and the cost of repairing a worn or damaged brush can be held to an absolute minimum by fabricating the brush from a plurality of mounting collars and a plurality of identical elongated bristle carrying members which can be easily mounted on and removed from the collars for replacement and/or repair.

A further object of the invention is the provision of a brush construction, as aforesaid, which can be mounted upon or removed from a supporting shaft without dismantling the shaft, and which is constructed so that replacement bristle carrying members, which occupy a relatively small amount of space, can be stocked for emergency repairs, and which can be applied to a damaged brush by a person capable of handling ordinary tools, such as a wrench.

Still a further object of the invention is the provision of a brush construction, as aforesaid, which utilizes fastening elements which are mounted on the bristle carrying members and coact with suitable slots formed in the collars, whereby the bristle carrying members can be mounted on or removed from the collars merely by tightening or loosening the fastening elements, respectively, so that the bristle carrying members can be mounted on or removed from the collars solely by displacing the bristle carrying members in the longitudinal direction thereof without requiring complete disconnection or removal of the fastening elements.

Other objects and purposes of the present invention will be apparent to persons familiar with brush constructions of this general type upon reading the following descriptive material and examining the accompanying drawings.

Figure 1:
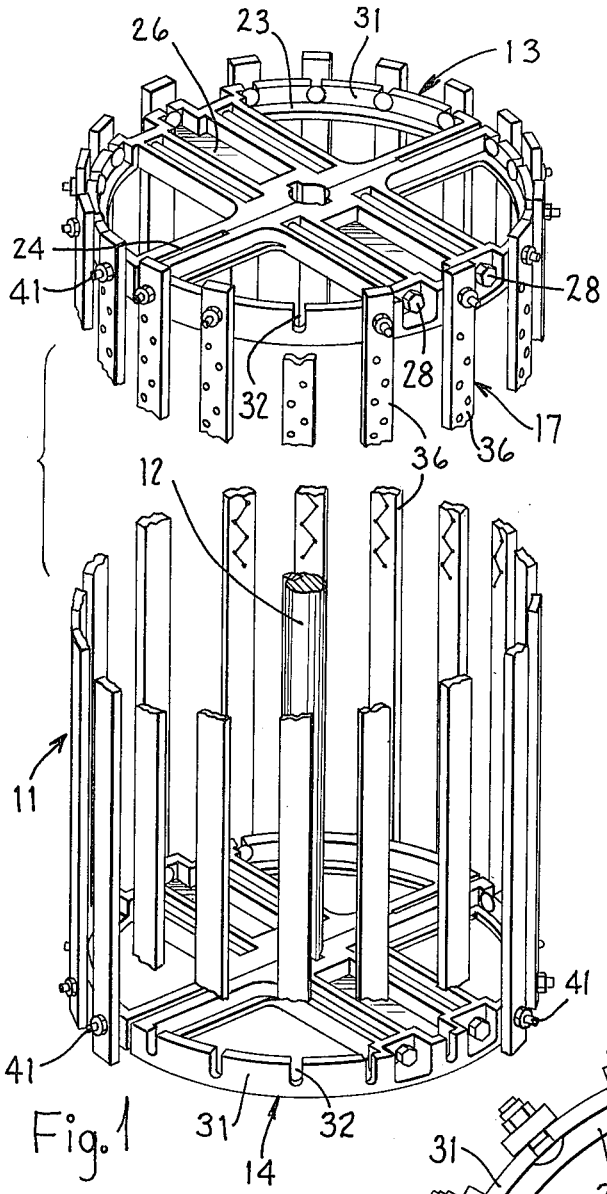
FIG. 1 is a broken perspective view of a rotary brush construction embodying the invention, which brush construction has been illustrated with the bristles removed for purposes of clarification.

Certain terminology will be used in the following description for convenience in reference only and will not be limiting. For example, the words "upper", "lower", "right" and "left" will refer to directions in the drawings to which reference is made. The words "inner" and "outer" will have reference to the geometric center of the construction and designated parts thereof. Said terminology will include the words above specifically mentioned, derivatives thereof, and words of similar import.

SUMMARY OF THE INVENTION

The objects and purposes of the invention, including those set forth above, have been met by providing a rotary brush construction having at least two axially spaced collars mounted upon a shaft, which collars are preferably diametrically split into two semicylindrical sections. A plurality of elongated bristle carrying members are mounted on the collars in substantially parallel relationship with the shaft, which members define a cylinder from which the bristles extend radially outwardly. The collars each have an axially extending annular flange containing a plurality of circumferentially spaced slots therein, which slots are axially elongated and open outwardly through one end of the flange. The collars are arranged so that the open ends of the slots are all directed in the same axial direction. Each bristle carrying member has a plurality of fastening devices mounted thereon, such as bolts, which bolts can be slidably inserted into the slots formed on the collars by slidably displacing the bristle carrying member longitudinally thereof relative to the collars. Tightening of the bolts permits the bristle carrying member to be fixed to the collars. The bristle carrying members can be removed by loosening the bolts and then longitudinally slidably displacing the bristle carrying members relative to the collars, whereby complete disconnection or removal of the bolts is not necessary.

DETAILED DESCRIPTION

Figure 3:
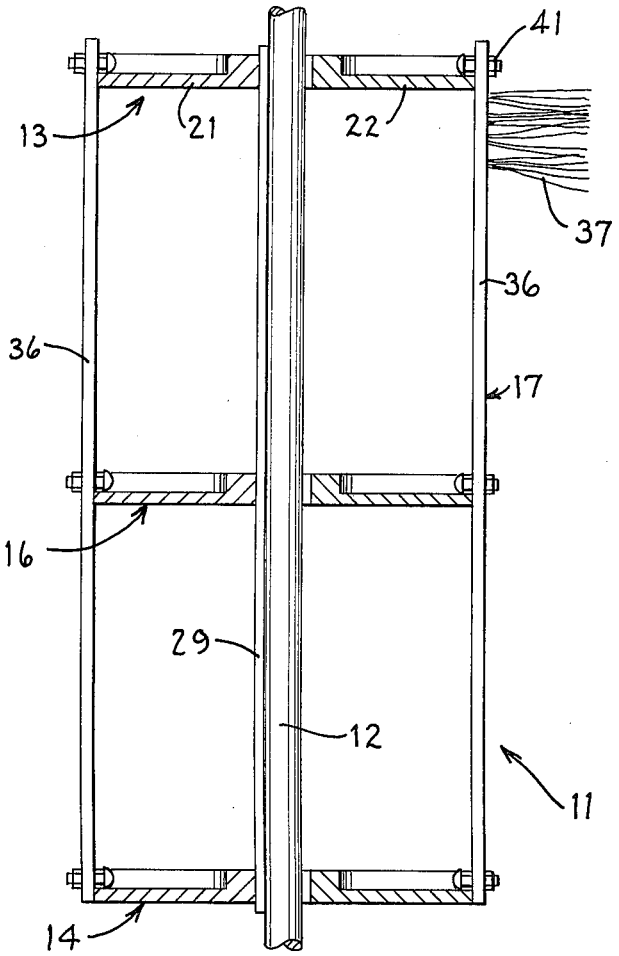
FIG. 3 is a view taken substantially along the line III—III in FIG. 2.

The rotary brush construction of the present invention, a preferred embodiment of which is illustrated at 11 in FIG. 1, is comprised of a pair of circular, and preferably identical, end bells or collars 13 and 14 which can be mounted in axially spaced relationship on a shaft 12. A center collar 16, which is preferably identical to the collars 13 and 14, can also be disposed between the collars 13 and 14 as illustrated in FIG. 3. The collars 13, 14 and 16 removably support a plurality of parallel, elongated brush strips 17, which brush strips 17 are normally referred to as bristle carrying members.

Figure 2:
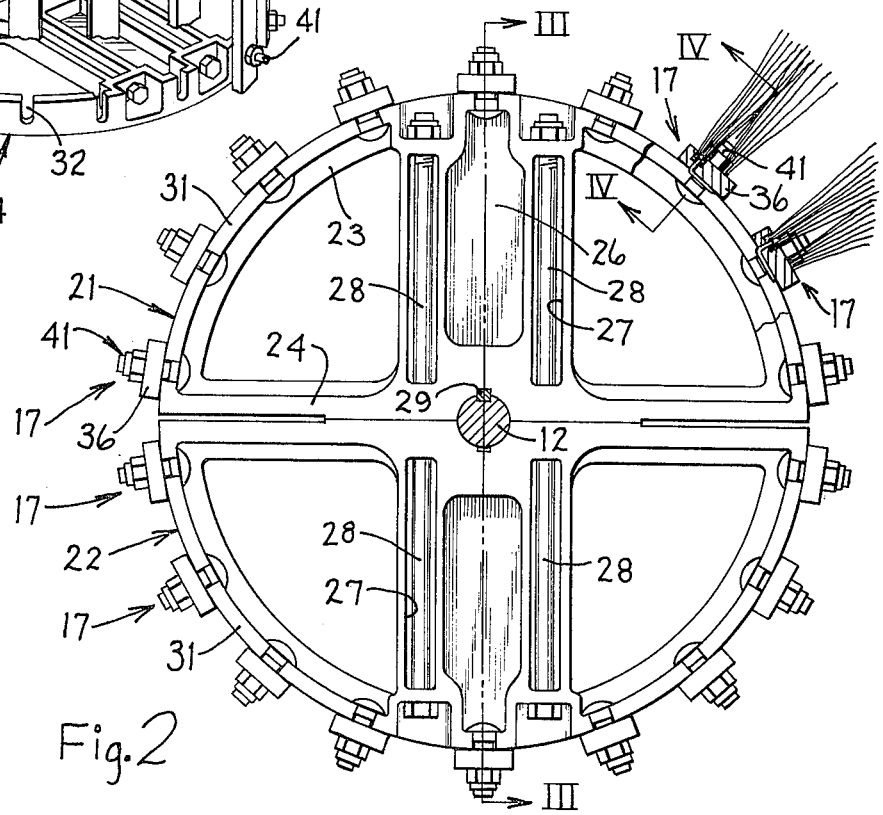
FIG. 2 is a top view of the brush construction illustrated in FIG. 1.

The end collar 13, by way of example and as shown in FIG. 2, is comprised of a pair of mating, semicircular sections 21 and 22, which sections are preferably identical. The section 21 has a radial wall 23 formed as an arcuate section extending through an angle of approximately 180°. The ends of the radial wall 23 are fixedly, here integrally, connected by a substantially diametrically extending flange 24, which flange 24 also defines a hub for the shaft 12. The arcuate radial wall 23 and the diametral flange 24 are joined substantially adjacent their midpoints by a strengthening web 26 which defines a pair of parallel elongated grooves 27 through which extend elongated connecting bolts 28. The semicylindrical collar sections 21 and 22 are fixedly connected to form an annulus by means of the elongated bolts 28, which bolts 28 are disposed on diametrically opposite sides of the shaft 12 and extend through the aligned grooves 27 formed in the sections 21 and 22. The bolts 28 clampingly secure the collar sections 21 and 22 in surrounding relationship to the shaft 12. A key 29 of conventional construction preferably interconnects the shaft 12 to at least one of the collar sections 21 and 22 for nonrotatably connecting same.

Each collar section 21 and 22 has an axially directed, substantially semicylindrical annular flange 31 which projects outwardly from one end of the radial wall 23. Each flange 31 has a plurality of circumferentially spaced slots 32 formed therein, which slots 32 are axially elongated and open outwardly through the free end of the flange. As illustrated in FIGS. 1 and 3, the collars 13, 14 and 16 are all oriented so that the flanges 31 associated therewith all project in the same direction, whereby the slots 32 likewise all open in the same direction. The slots 32 all open upwardly in the positional arrangement illustrated in FIGS. 1 and 3. The purpose of this structure will be explained hereinafter.

Considering now the brush strips 17, each includes an elongated barlike member 36 having a plurality of bristles 37 mounted thereon, which bristles extend radially outwardly of the bar 36. The bristles are grouped within clusters, with a plurality of said clusters being mounted on each individual bar 36. The manner in which the bristles 37 are mounted on the individual bars 36 may be in accordance with numerous known techniques, some of which are illustrated in abovementioned U.S. Pat. No. 3,529,314. Since the mounting of the bristles on the bar is conventional, further description of same is not believed necessary.

Figure 4:
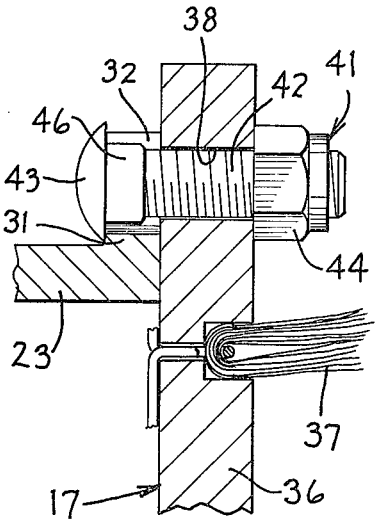
FIG. 4 is an enlarged fragmentary sectional view taken along the line IV—IV in FIG. 2.

The bar 36 is of sufficient length so as to extend axially between at least a pair of spaced collars, with the bar 36 in the illustrated embodiment being of a length sufficient to extend between the end collars 13 and 14. Each bar 36 also has a plurality of openings 38 (FIG. 4) extending therethrough, with one said opening 38 being disposed for association with each of the collars 13, 14 and 16.

To permit mounting of the brush strip 17 on the collars, each brush strip is provided with a plurality of fastening devices 41 mounted thereon, there being one fastening device 41 positioned for association with each of the axially spaced collars. The fastening device 41 is most clearly illustrated in FIG. 4 and, in a preferred embodiment, comprises a threaded bolt having a shank 42 positioned within and extending through the opening 38 formed in the member 36. The shank 42 has an enlarged head 43 formed at one end thereof, and has a nut 44 threadably engaged on the other end therof. The shank 42 is of sufficient length to extend through not only the opening 38 but also through one of the slots 32. Tightening of the bolt, such as by tightening the nut 44 onto the shank 42, thus causes the member 36 to be clampingly engaged to the outer periphery of the annular flange 31.

In a preferred embodiment of the invention, the shank 42 is provided with a holding portion 46 positioned directly adjacent the head 43, which holding portion preferably has a pair of opposed and substantially parallel flat sides thereon which are spaced apart by a distance substantially equal to or slightly less than the width of the slots 32. In this manner, the holding portion, which may have the configuration of a polygon (such as a square or a hexagonal cross section) when viewed in cross section can be slidably inserted into the slot 32 whereby the sidewalls of the slot maintain the holding portion 46 in a nonrotatable condition. With this structure, it is thus not necessary to utilize a tool for engaging the head 43, and the head 43 can thus be rounded.

OPERATION

The operation of the brush construction 11 is conventional in that the brush 11 is rotated by means of a suitable drive device, such as a motor (not shown), which motor is drivingly connected to shaft 12 for causing rotation of the brush construction 11 in the desired manner. The operation of such a brush construction in car washing operations is well known.

When it is desired to replace one or more of the brush strips 17, either due to the brush strips being worn or damaged, then the selected brush strip 17 can be suitably removed from the collars by first loosening the fastener device 41 as associated with each of the collars 13, 14 and 16. This loosening merely requires that the nut 44 be rotated so as to loosen the fastening device. However, the rotation of the nuts 44 is limited so that the nuts do not become disconnected from the shanks 42, whereby the fastening devices 41 remain attached to the respective bar 36. After all of the fastening devices 41 associated with the selected bar 36 have been loosened, then the bar 36 is slidably displaced in its lengthwise direction relative to the collars, which slidable movement of the bar 36 occurs upwardly in FIGS. 1 and 3 in a direction substantially parallel to the axis of the shaft 12. This lengthwise slidable movement of the bar 36 results in the fastening devices 41, and particularly the holding portions 46 thereof, being slidably moved through the free ends of the slots 32. In this manner, the selected bar 36 is easily disconnected from all of the mounting collars without requiring complete disassembly of the fastening devices 41.

When a new brush strip 17 is to be remounted on the collars, and assuming that the fastening devices 41 are in a loosened but not disconnected condition, then the bar 36 is positioned so as to lie substantially flush with the external periphery of the collars but with the shanks 42 of the fastening devices 41 being axially spaced from but substantially aligned with the open ends of the slots 32. The bar 36 is then slidably displaced lengthwise thereof (downwardly in FIGS. 1 and 3) relative to the collars so that the shanks 42 enter into the slots 32. The individual fastening devices 41 are then tightened, as by rotating the nuts 44, whereby the brush strip 17 is fixedly secured to the individual collars.

MODIFICATION

Figure 5:
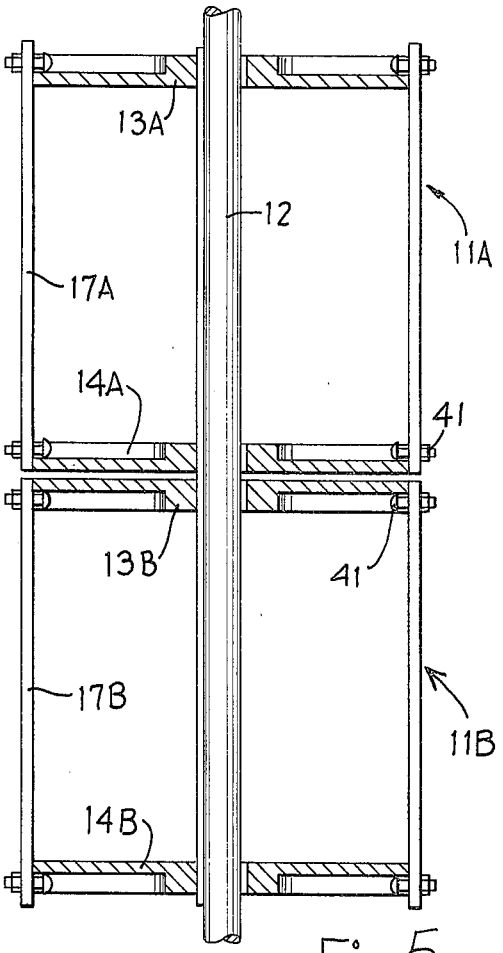
FIG. 5 is a sectional view similar to FIG. 3 and illustrating therein a modified brush construction.

FIG. 5 illustrates therein a brush construction which is similar to FIGS. 1–4 in that it includes a first brush 11A having a pair of identical end collars 13A and 14A mounted on the driving shaft 12. The brush 11A includes a plurality of brush strips 17A mounted on the collars in a cylindrical pattern, with the individual brush strips being connected by means of fastening devices identical to that illustrated in FIG. 4. The collars 13A and 14A each have axially extending slots formed in the annular flanges thereof, which slots open upwardly, whereby the individual brush strips 17A can be removed from the collars by being slidably displaced upwardly in the lengthwise direction thereof.

The brush construction of FIG. 5 includes a further brush 11B which is positioned directly adjacent and axially aligned with the brush 11A. The brush 11B is constructed in the same manner as the brush 11A and includes a plurality of removable brush strips 17B mounted on collars 13B and 14B. In this arrangement, however, the axially elongated slots formed in the annular flanges of the collars 13B and 14B open downwardly, whereby the individual brush strips 17B can be removed from the respective collars by displacing the brush strips lengthwise thereof in a downward direction as viewed in FIG. 5. By having the brush strips 17A and 17B removable by displacing same lengthwise thereof in opposite directions relative to one another, the brushes 11A and 11B can be positioned closely adjacent one another so as to give the effect of a single or continuous brush.

While the present invention discloses and preferably utilizes a plurality of individual elongated brush strips, it will be recognized that the present invention could also be utilized with brush strips which extend through a greater arcuate extent, whereby fewer brush strips would thus be used to generate the cylindrical arrangement of the brush. If the individual members 36 are of increased arcuate extent, then each individual member may be designed to cooperate with two or more adjacent slots 32 as formed in the respective collars. In its broadest sense, it will be recognized that the plurality of individual bars 36 could be replaced by a pair of semi-cylindrical shells each having a plurality of bristles mounted thereon, which shells could each have a plurality of fastening devices mounted thereon and positioned for slidable engagement with a plurality of adjacent slots as formed in the respective collars.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a rotary brush structure adapted for removable attachment to shaft means, said brush structure having a pair of substantially circular end collars adapted for attachment to said shaft means, each end collar having an axially extending circumferential flange, a plurality of elongated bristle carrying members extending axially between said collars, and fastening means for securing said birstle carrying members to the circumferential flanges of said collars, comprising the improvement wherein each of said circumferential flanges has a plurality of circumferentially spaced slots formed therein and extending substantially axially thereof, one end of each slot opening outwardly through one end of the respective circumferential flange, all of the slots associated with all of the circumferential flanges opening outwardly in the same axial direction, and said fastening means including a plurality of fastening devices mounted on said bristle carrying member, there being at least one fastening device mounted on said member and disposed for association with each of said collars, each fastening device including a portion adapted to be slidably inserted into one of said slots through the open end thereof, whereby the individual bristle carrying member can be attached to or removed from the collars by slidable movement of the bristle carrying member relative to the collars in the lengthwise direction thereof, said fastening device comprising a threaded fastening member mounted on said bristle carrying member and removable therewith from said collars, said bristle carrying member having an opening extending therethrough, said threaded fastening member including a shank extending through said opening and being of sufficient length so as to also extend through one of said slots, said threaded fastening member also having an enlarged head portion formed on the inner end thereof as disposed adjacent the inner side of said bristle carrying member, a threaded element engaged with the other end of said shank for connecting said fastening device to said bristle carrying member, and said shank having a portion of noncircular cross section disposed adjacent said head and adapted for slidable engagement within one of said slots for preventing rotation of said shank relative to the collar.

2. A brush construction according to claim 1, wherein each of said collars includes a pair of substantially identical semicylindrical collar sections adapted to be fixedly connected together in surrounding and nonrotatable relationship to said shaft means.

* * * * *